US005967437A

United States Patent [19]

Martin-Cocher et al.

[11] Patent Number: 5,967,437

[45] Date of Patent: Oct. 19, 1999

[54] MACHINE FOR WINDING FILM, A METHOD OF MAKING SPOOLS OF PRE-STRETCHED FILM, AND SPOOLS OF PRESTRETCHED FILM OBTAINED THEREBY

[75] Inventors: Jean Paul Martin-Cocher, La Motte Servolex; Georges Jaconelli, Brison Saint-Innocent, both of France

[73] Assignee: Thimon, Aix-Les Baines, France

[21] Appl. No.: 09/076,910

[22] Filed: May 13, 1998

[30] Foreign Application Priority Data

May 13, 1997 [FR] France ..... 97 05857

[51] Int. Cl.[6] ..... B65H 18/28

[52] U.S. Cl. ..... 242/160.4; 242/176

[58] Field of Search ..... 242/160.1, 160.4, 242/174, 176, 178; 428/121, 126, 156

[56] References Cited

U.S. PATENT DOCUMENTS 3,297,155 1/1967 Gattenby, Jr. et al. ..... 242/160.1
4,934,622 6/1990 Hakiel ..... 242/160.4
5,531,393 7/1996 Salzsauler et al. .

FOREIGN PATENT DOCUMENTS 656 853 B1 6/1995 European Pat. Off. .
2288594 10/1995 United Kingdom .

*Primary Examiner*—John P. Darling
*Attorney, Agent, or Firm*—Lowe Hauptman Gopstein Gilman & Berner

[57] ABSTRACT

A machine for winding film, a method of manufacturing spools of pre-stretched film, and spools of pre-stretched film obtained as a result, are disclosed. The method of winding spools of pre-stretched stretchable film includes importing oscillation to the film with a component perpendicular to the axis of the film. For example, during pre-stretched and winding of the film on a take-up spool, a feed spool, i.e. a spool from which the stretchable film for stretching is taken, is caused to oscillate, and/or the take-up core is caused to oscillate. This ensures that successive layers of film are offset, in particular at the margins of the film. Spools of film obtained in this way do not have portions of extra thickness and lower tension at the margins as is the case prior art spools of pre-stretched film.

22 Claims, 5 Drawing Sheets

MACHINE FOR WINDING FILM, A METHOD OF MAKING SPOOLS OF PRE-STRETCHED FILM, AND SPOOLS OF PRESTRETCHED FILM OBTAINED THEREBY

The present invention relates mainly to a machine for winding film, to a method of making spools of pre-stretched film, and to spools of pre-stretched film obtained thereby.

BACKGROUND OF THE INVENTION

Prior stretching advantageously includes a step of paying out the film from a feed spool, a step of stretching it, and a step of winding the stretched film on a take-up spool or core, ready for subsequent use.

Immediately after being stretched, stretchable film is subject to relaxation which leads, over a period that is substantially equal to 48 hours, to the elastic return force being reduced substantially by 50%.

In French patent application No. 92 10254 published under the No. FR-A-2 695 102, the Applicant describes a method of manufacturing pre-stretched film that is relaxed under the stretching tension, and in European patent application No. 97 401 005.0 published under the No. EP-A1-0 806 284, the Applicant describes a method of manufacturing pre-stretched film that is relaxed under low mechanical tension.

Pre-stretched film of known type is wound on cylindrical cores. The film is paid out from the core and is wrapped, e.g. helically, around a load to form an outer wrapping thereabout.

Unfortunately, pre-stretched stretchable film wound on a core turns out to be particularly fragile. For example, being dropped on the ground runs the risk of creating zones of weakness or holes in the margin of the film. Such zones of weakness or such holes in the margin of the film can start tears while a load is being wrapped, or even worse, while a wrapped load is being handled or transported, with the attendant risk of the load being dislocated.

In addition, when the thickness of a film is not absolutely constant, and the film is wound on a core, in particular a core made of card, then overlap zones are generated at the margins between successive layers that impede proper paying out of the film during wrapping, and this can go as far as causing the film to tear.

U.S. Pat. No. 5,531,393 describes a machine for anticipated stretching of a stretchable film for the purpose of texturing the film to facilitate unwinding. The margins of the film are folded over. Reciprocating horizontal motion of the take-up spool spreads out the resulting extra thickness.

GB-A-2 288 594 describes a device provided with means for winding film on a horizontal axis spool driven with reciprocating motion.

Neither of those two documents describes or suggests forming frustoconical or substantially conical end zones that facilitate unwinding of the film, particularly when it is done manually.

OBJECTS AND SUMMARY OF THE INVENTION

Consequently, an object of the present invention is to provide a pre-stretched spool of film suitable for being unwound easily without catching or running the risk of tearing.

Another object of the present invention is to provide a spool of pre-stretched stretchable film that has good resistance to impact.

Another object of the present invention is to provide a spool of pre-stretched film that is of regular shape without local extra thickness, thus minimizing the volume required for storing the spool prior to use.

Another object of the present invention is to provide a spool of pre-stretched stretchable film having high resistance to braking, particularly while the film is being placed manually around a load.

These objects are achieved by the method of the present invention of winding spools of pre-stretched stretchable film in which the film is caused to oscillate, advantageously with a component perpendicular to the axis of the film. For example, while the film is being pre-stretched and wound on the take-up core, oscillation is imparted to the feed spool, i.e. the spool from which the stretchable film that is to be stretched is taken, and/or oscillation is imparted to the take-up core. This ensures that successive layers of film are offset, and in particular that the margins of successive layers are offset. Spools of film obtained in this way present film without extra thickness and that is under lower tension in its margins than is the case in known types of pre-stretched film.

The invention mainly provides a machine for winding pre-stretched film from a feed spool onto a spool for taking up pre-stretched film, the machine comprising means for rotating the pre-stretched film take-up spool and/or the film feed spool, and including means for driving the said feed spool relative to the said take-up spool in such a manner as to vary periodically the positions of the margins of the film along the axis of the take-up spool, in such a manner that the margin of the wound film has a profile that is frustoconical or substantially conical.

The invention also provides a machine wherein the means for driving the feed spool relative to the take-up spool provide relative displacement of an amplitude enabling the frustoconical or substantially conical profile of the film margin to be formed on said take-up spool so as to form an angle $\alpha$ relative to an axis of the take-up spool where $\alpha$ lies in the range 1° to 80°, preferably in the range 3° to 45°, and advantageously in the range 5° to 45°.

The invention also provides a machine, including means for imparting oscillating reciprocating drive to the feed spool parallel to its axis and/or means for imparting oscillating reciprocating drive to the take-up spool parallel to its axis.

The invention also provides a machine, wherein the reciprocating drive means comprise a wheel that is elliptical, oval, eccentric, or the like, rotated about an axis orthogonal to the axis of rotation of the feed spool and/or of the take-up spool; said wheel driving said feed spool and/or said take-up spool parallel to said axis of rotation of the spool.

The invention also provides a machine, further including stretching means for stretching a stretchable film, film guide means, and means for winding stretched film on the take-up spool.

The invention also provides a machine, further including means for partially releasing the mechanical tension in the film after stretching and prior to winding on the take-up spool.

The invention also provides a method of winding pre-stretched film, the method comprising a step of stretching a film and a step of winding the stretched film on a take-up spool, wherein, during winding, relative displacement is ensured between film feed means and the take-up spool in such a manner as to vary the positions of the margins of the film periodically along the axis of the take-up spool, so that the margins of the wound film present a frustoconical or substantially conical profile on the take-up spool.

The invention also provides a method, wherein the displacement of the film feed means relative to the take-up spool is displacement of the feed spool parallel to its axis and/or of the take-up spool parallel to its axis.

The invention also provides a method, wherein the amplitude of the displacement lies in the range 1% to 4%, and preferably in the range 2% to 2.4%, of the width of the film.

The invention also provides a method, wherein winding is performed with the positions of the margins of the film along the axis of the take-up spool being varied periodically at the outlet from the film stretching means.

The invention also provides a method, wherein the feed spool is caused to perform oscillating reciprocating motion parallel to its axis.

The invention also provides a method, wherein outer wrapping film is wound on the take-up spool after it has been subjected to stretching at a tension lying in the range 10 $N/mm^2$ to 20 $N/mm^2$ of the initial cross-section of the film, and wherein the winding and the relaxation of the film on the take-up spool takes place under mechanical tension lying in the range 10% to 90% of the stretching tension.

The invention also provides a spool of pre-stretched film obtained by such a method.

The invention also provides a spool of film, wherein the ratio of the mechanical tension in the film wound on the central portion of the film spool relative to the tension in the margins lies in the range 1 to 5, preferably in the range 1 to 3, and even more preferably in the range 1.5 to 2.5.

The invention also provides a spool wherein the frustoconical or substantially conical profile forms an angle with the axis of the spool, said angle lying in the range 1° to 80°, preferably in the range 3° to 45°, and advantageously in the range 5° to 45°.

BRIEF DESCRIPTION OF THE DRAWINGS

The invention will be better understood from the following description and the accompanying drawings given as non-limiting examples, and in which:

In FIGS. 1 to 11, the same references are used to designate the same elements.

MORE DETAILED DESCRIPTION

Figure 1:
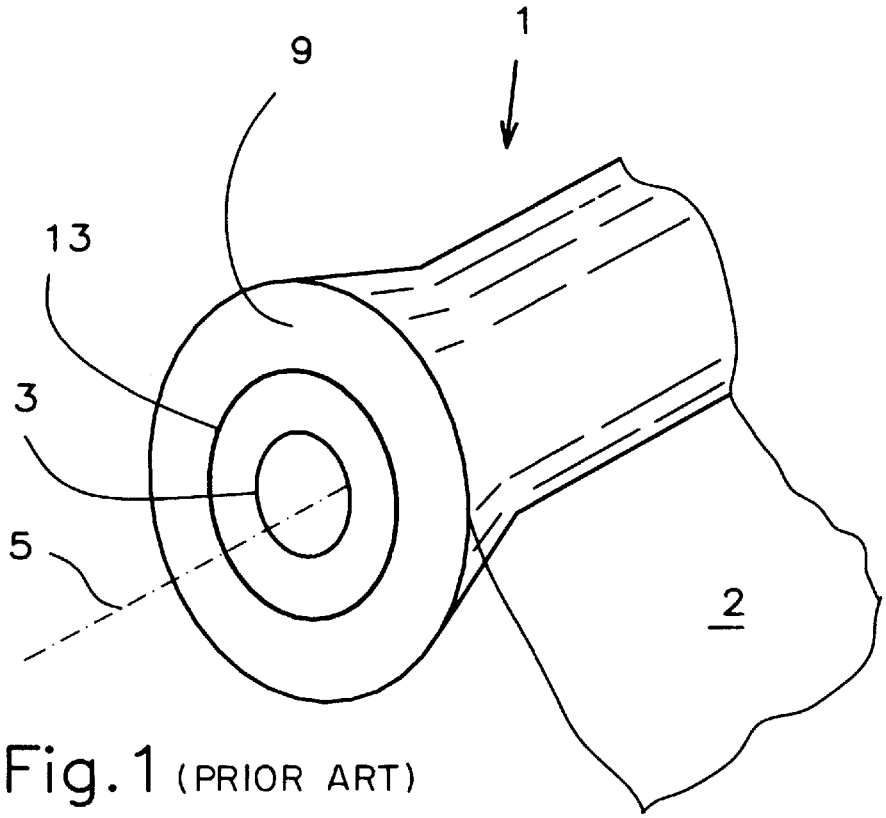
Fig. 1 (PRIOR ART)
FIG. 1 is a perspective view of an end of a spool of pre-stretched film of known type.
Figure 2:
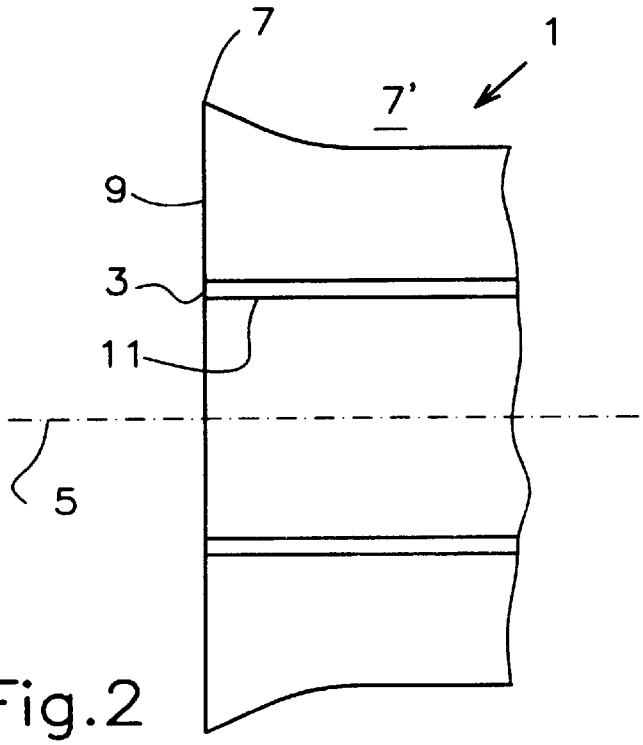
Fig. 2 (PRIOR ART)
FIG. 2 is an axial section view through the end of the FIG. 1 spool.

In FIGS. 1 and 2, there can be seen the end of a spool of pre-stretched film 2 wound on a cylindrical core 3 of axis 5. The margin 7 of the film of the spool 1 presents frustoconical extra thickness flaring towards the end of the spool and terminating in a flank 9 that is substantially perpendicular to the axis 5.

Even for a film of perfectly uniform thickness, the spool of FIGS. 1 and 2 suffers from numerous drawbacks. A gap 7' defined by the two extra thicknesses of the margins 7 at axially opposite ends constitutes wasted space that increases the volume occupied by a set of spools placed in packaging.

The tension in the film 2 in its margin 7 is considerably greater (e.g. equal to 1.4 N/cm) than the tension in the central portion of the film between the margins 7 (e.g. 0.7 N/cm) for a film having a thickness of 20 $\mu$m to 23 $\mu$m and a width of 500 mm. This localized extra tension weakens the film and makes it more difficult to pay out. In addition, the junction between the flank 9 and the margin 7 is of small area which, in the event of the spool 1 being dropped and taking account of the extra tension that obtains in the margin 7, runs the risk of giving rise to zones of weakness, microtears, or microholes liable to start tears in the film while it is being put into place.

When the film 2 is put into place manually, spools 1 of known type are braked by the operator pressing fingers against the flanks 9 of the film 2 and/or against an inside surface 11 of the core 3. Applying finger pressure to the flank 9 while the film 2 is being paid out increases the chance of the film tearing since that pressure is applied specifically to the margins of the film where the film is weaker because it is subject to considerable mechanical tension.

Unfortunately, it is extremely difficult to extrude a film of constant thickness. Thus, it is quite common to have several tens of layers of relatively fine film 13 superposed on several tens of layers of thicker film, and/or vice versa. During pre-stretching prior to winding on the spool, the stretching of the relatively fine zone of the film causes its width to be reduced to a greater extent (known as "necking-down"). Under such circumstances, it often happens that outer layers of the margin 7 are obtained which are partially covered by overlapping inner layers that hinder proper paying out of the film and that can also give rise to tearing while the film is being paid out.

Figure 7:
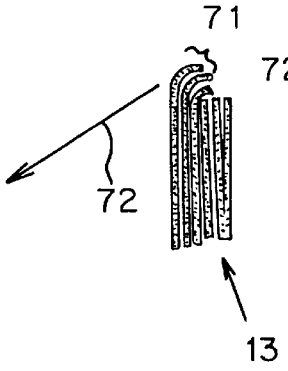
Fig.7 (PRIOR ART)
FIG. 7 is a section view showing a detail of a zone in FIG. 1 on a larger scale.
Figure 8:
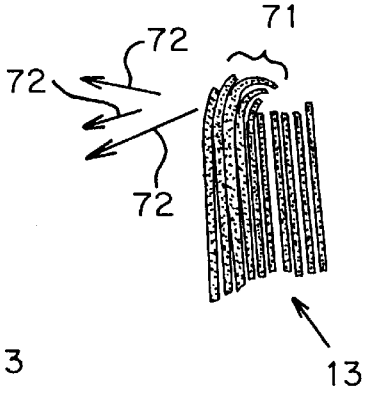
Fig.8 (PRIOR ART)
FIG. 8 is a section view showing another detail of FIG. 1, likewise on a larger scale.

In FIGS. 7 and 8, there can be seen at 71 two examples of the margins of successive layers of film having greater thickness. During stretching, the layers of greater thickness also have greater width, and as a result, as shown in FIGS. 7 and 8, they curve over and cover the margins of adjacent layers of film. As a result, when the film is being paid out, and in particular when it is being paid out in directions as shown by arrows 72, there is a danger of the margin of the film 2 being broken.

Figure 3:
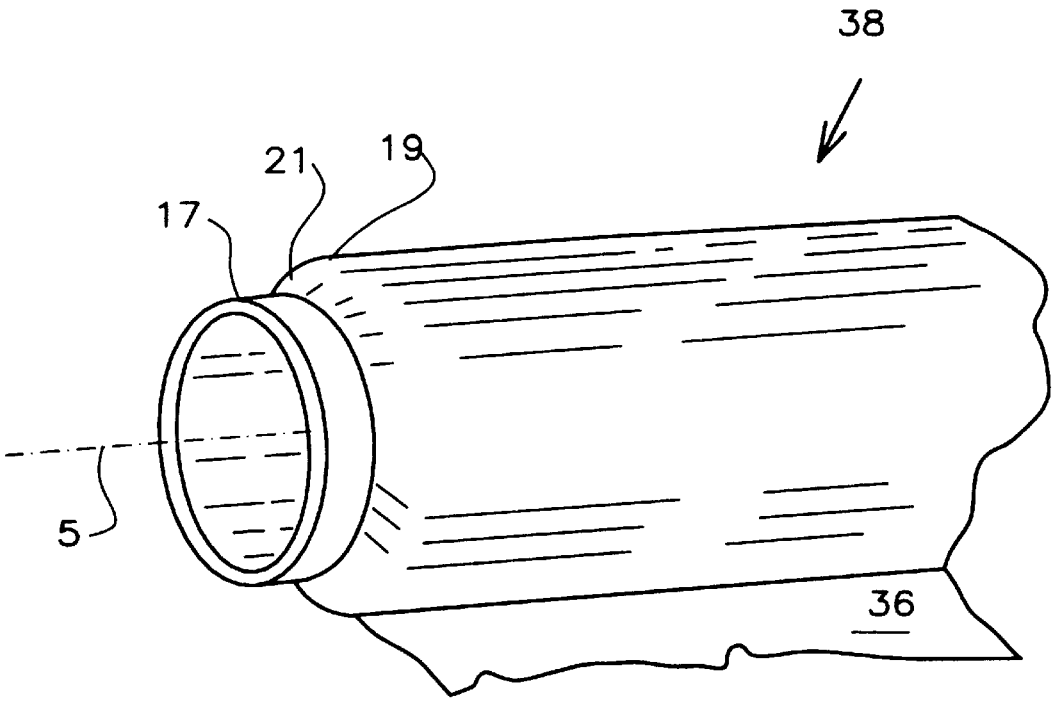
FIG. 3 is a perspective view of one end of a spool of pre-stretched film, wound by the method of the present invention.
Figure 4:
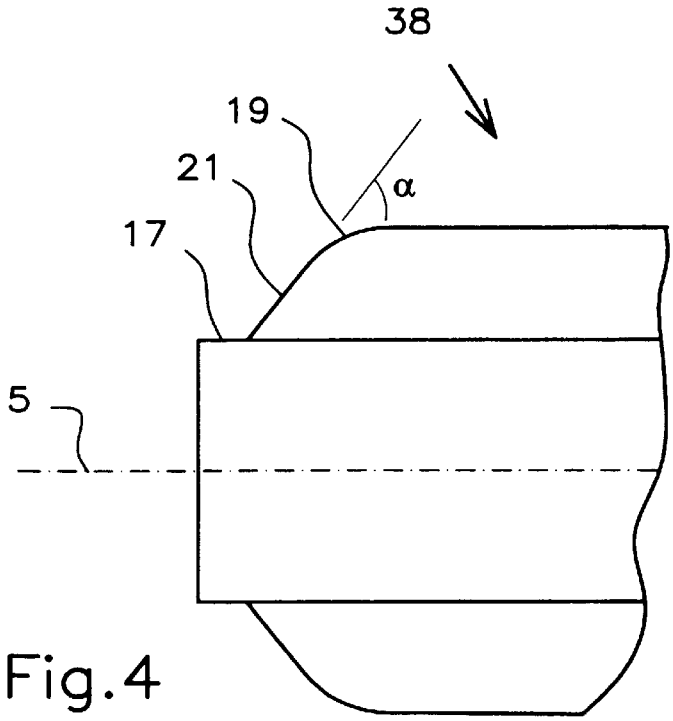
FIG. 4 is an axial section view through the end of the FIG. 3 spool.

FIGS. 3 and 4 show a spool 38 of the present invention which has been wound, advantageously during pre-stretching, with the film 36 being displaced, advantageously in periodic manner, parallel to the axis 5 of the core 17 so as to move the margins of the film 36 axially and avoid superposing the margins of successive layers of the film 36. This reduces or eliminates the extra thickness at the margin. On the contrary, after a rounded edge 19, the margin 21 of the film comes closer to the axis 5 as it comes closer to the end of the spool. The profile of the margin 21 is frustoconical, as shown in FIGS. 3 and 4, or is substantially conical, forming an angle α relative to the axis 5 of the core 17 where α lies in the range 1° to 80°, preferably in the range 3° to 45°, and advantageously in the range 5° to 45°, and is equal to 33°, 40°, or 45°, for example. Decreasing the angle makes the film easier to pay out but also decreases the quantity of film that can be stored on a core, since for given oscillation it is this angle which defines the outside diameter of the film as a function of the outside diameter of the core. A stickier film that is more difficult to pay out requires a larger angle α.

The spool 38 of the present invention presents numerous advantages. Firstly, the tension in the margin 21 is substantially equal to or less than that present in the central portion of the film. For a film having a thickness of 20 μm to 23 μm and a width of 500 mm, the tension in the margin may lie in the range 0 to 1 N/cm, preferably in the range 0.1 N/cm to 0.8 N/cm, more preferably in the range 0.2 N/cm to 0.7 N/cm, e.g. being equal to 0.4 N/cm or 0.7 N/cm.

In this way, the margin 21 of the film 36 of the spool 38 of the present invention is indeed stronger than the margin 7 of the film 2 of the known type of spool 1. The radial superposition of layers in the margin 21 does not impede paying out of the film by generating overlapping layers.

Better resistance to being dropped is obtained not only by having lower tension in the margin 21, but also by having a rounded edge 19 to the roll of film on the spool. In addition, the margins 21 of the outer layers go beyond the edge 19. Thus, if a microtear or opening should form in the rounded edge 19 it weakens the film less than would the same microtear or opening if present in the margin of the film, and consequently it has less tendency to start a tear in the film 36. Advantageously, the core 17 is of a length that is greater than the width of the film so that its end projecting beyond the film damps the impact in the event of the spool falling vertically.

The absence or decrease in local extra thicknesses makes it possible to reduce cost by reducing the volume of packaging containing a plurality of spools of the present invention.

While the film 36 is being paid out from the spool 38 of the present invention, the film slides or rolls without problem over the film forming the layer immediately beneath, even when performing helical wrapping with large amplitude displacement of the spool 38 of film parallel to its axis 5 during successive helical turns formed by the film 36.

Preferred embodiments of spools of film in accordance with the invention:

EXAMPLE 1

Film of medium stickiness:
outside diameter: 105 mm
core diameter: 68 mm
amplitude of margin displacement: 20 mm
α=42°.

EXAMPLE 2

Film of low stickiness:
outside diameter: 150 mm
core diameter: 68 mm
amplitude of margin displacement: 15 mm
α=70°.

EXAMPLE 3

Very sticky film:
outside diameter: 95 mm
core diameter: 68 mm
amplitude of margin displacement: 20 mm
α=32°.

Figure 5:
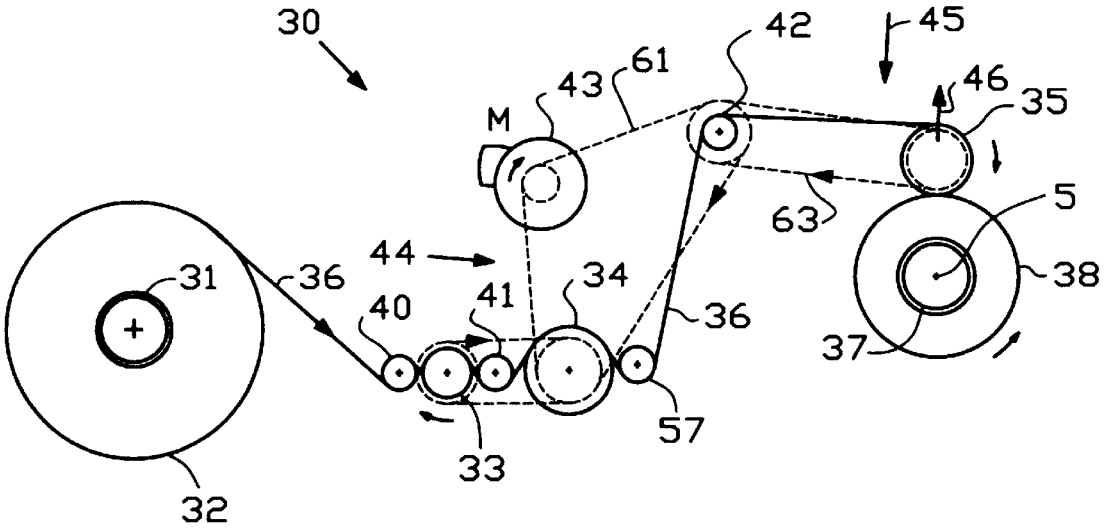
FIG. 5 is a plan view of a machine of the invention for making a spool of film.

In FIG. 5, there can be seen an embodiment of a machine 30 for prior stretching with relaxation of the film in accordance with the present invention. The machine 30 has means 31 for receiving a spool 32 of film to be stretched, a pair of film-stretching rollers 33 and 34, a roller 35 for partially releasing the tension in the film 36, means 37 for receiving a spool 38 of stretched and relaxed film, deflection rollers 40, 41, 57, and 42, and at least one motor 43. Advantageously, the roller 35 drives the take-up spool 38. Motion transmission means 44 comprising chains, cog belts, gearing, and/or a gearbox serve to enable the motor 43 to drive the rollers 33, 34, and 35. For example, the transmission means 44 comprise a chain or belt 61 driven by the shaft of the motor 43 and driving the shafts of the rollers 34 and 42. A second belt or chain 63 connects the shaft of roller 42 to the shaft of roller 35. Means represented by arrow 45 apply the stretched and relaxed film from the roller 35 against the spool 38. The roller 35 moves away from the axis of the spool 38 along arrow 46 as the diameter of the spool 38 increases with film being wound thereon. Advantageously, the rollers 33, 34, and/or 35 are grooved, knurled, and/or provided with a surface that adheres well to the film. Advantageously, a film path is provided between the rollers 34 and 35 that is longer than 0.5 meters (m) long, e.g. 0.8 m long so as to enable the film 36 to return elastically in a transverse direction prior to being wound on the spool, thereby releasing the transverse tension generated in the film by the longitudinal stretching tension. This makes it easier to wind the film on the spool 38 and subsequently to pay it out therefrom.

Figure 6:
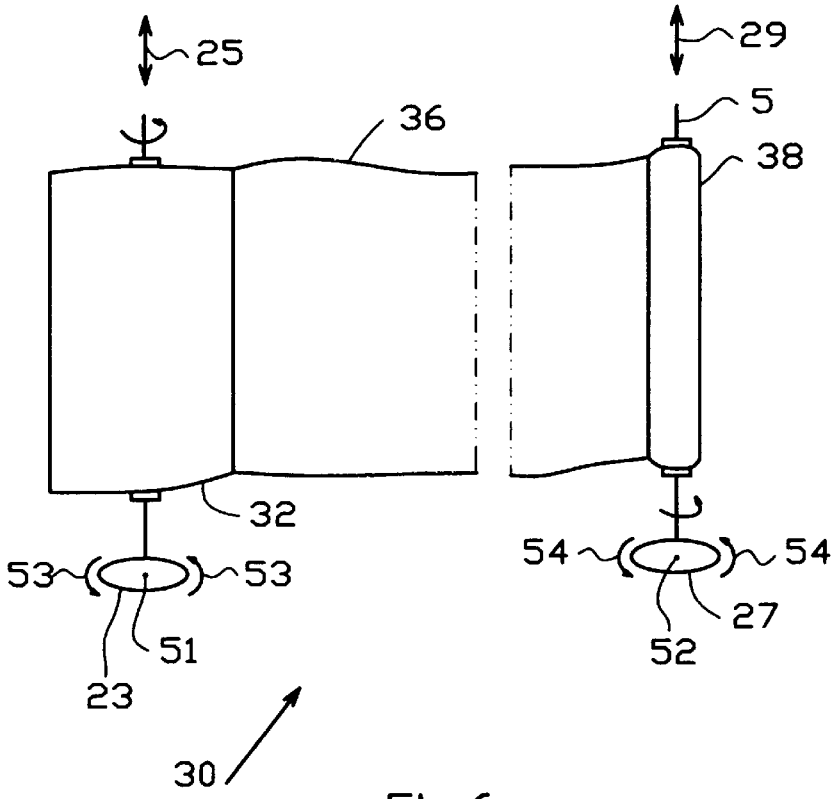
FIG. 6 is a side view of certain elements of the FIG. 5 machine.

The machine 30 of FIG. 6 includes means 23 for displacing 25 the spool 32 of film 36 to be stretched, advantageously in periodic manner, and/or means 27 for displacing 29 the spool 38 of stretched film. The displacement of the spool 32 and/or 38 provides preferably periodic axial displacement of the margins of the film 36 on the spool 38. The displacement may be constituted, for example, by tilting motion of the axis of the spool 32 or the axis 5 of the spool 38. Advantageously, it is constituted by rectilinear motion in translation of the spools along their axes. The means 23 and/or 27 may comprise eccentrics, crank type mechanisms, or advantageously, as shown, an elliptical wheel whose axis 51 or 52 of rotation 53 or 54 is perpendicular to the axis of the corresponding spool 32 or 38, thereby reducing the time during which the spool 32 and/or 38 occupies its extreme positions corresponding to the wheel 23 and/or 27 contacting the shaft(s) of the spools 32 and/or 38 via the ends of the major and minor axes of the ellipse(s).

Figure 9:
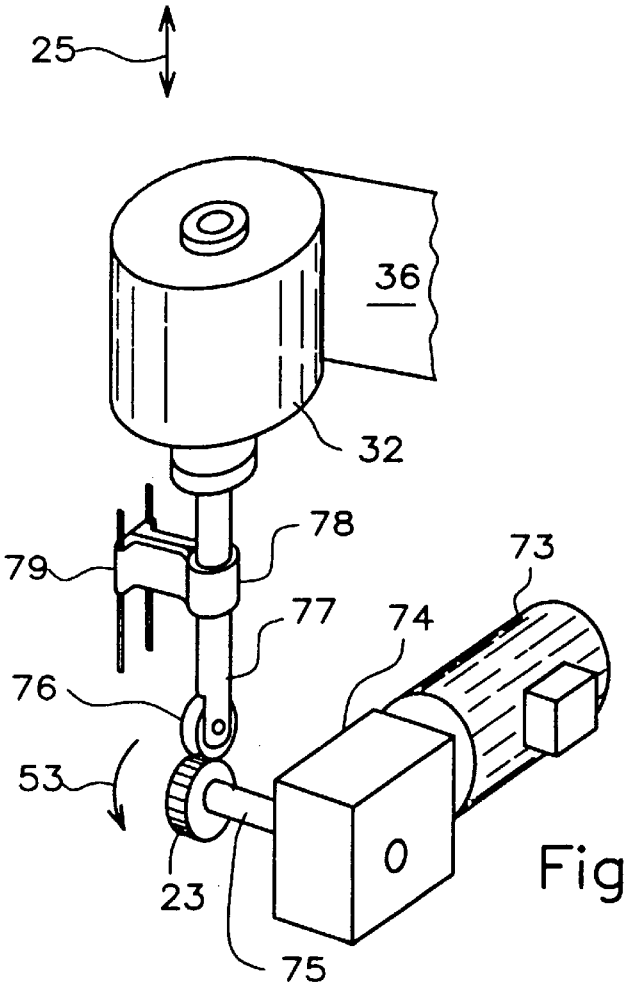
FIG. 9 is a perspective view showing a detail of the FIG. 5 machine.

FIG. 9 shows an embodiment of drive means for driving the feed spool 32 relative to the take-up spool 38. These drive means in FIG. 9 comprise a motor 73 (advantageously an electric motor), a gearbox 74 provided with an outlet shaft 75 driving an elliptical, oval, eccentric, or similar wheel 23. Advantageously, the wheel 23 is interchangeable with wheels of different shapes and/or sizes, so as to be able to adjust the amplitude and/or the frequency of the oscillations. The bottom end of the shaft 77 for rotating the spool 32 is advantageously fitted with a wheel 76 that rolls on the wheel 23. A guide ring 78 fixed on a support 79 provides guidance in translation 25 for the shaft 77 and thus for the spool 32.

The machine of the present invention advantageously includes means for synchronizing the wheels 23 and 27 with the means for driving the film 36 and/or the spools 38 and 32.

The wheels 23 and 27 can be oval in shape or circular and eccentric, i.e. having a respective axis of rotation 51 or 52 that do not pass through their centers.

By way of example, the oscillation can have an amplitude of 12 mm for film having a width of 0.5 m, and can be at a frequency corresponding to several turns of the spool 38, e.g. 5 or 6 turns, for a film travel speed of 300 meters per minute. Nevertheless, it should be understood that these values are not limiting, the frequency at which the spools 32 and/or 38 oscillate can lie in the range 3 to 20, and preferably in the range 4 to 15, and the travel speed can lie in the range 50 m/min to 1000 m/min, and preferably in the range 300 m/min to 500 m/min, while the displacement amplitude may lie in the range 5 mm to 20 mm, and preferably in the range 10 mm to 12 mm.

Figures 10, 11:
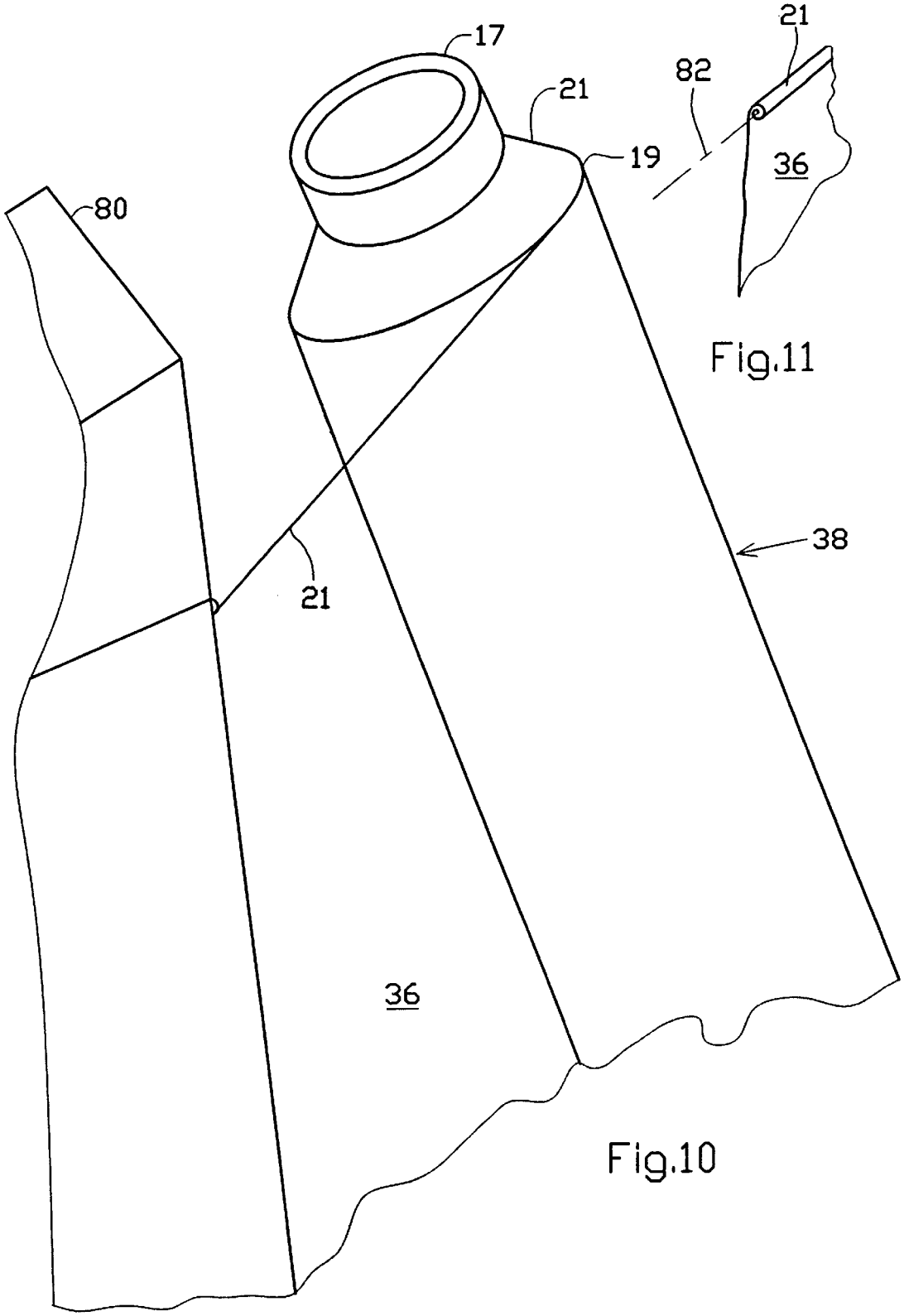
FIG. 10 is a perspective view of one end of a FIG. 3 spool while being wrapped manually around a load.
FIG. 11 shows the margin of the FIG. 10 film on a larger scale.

While a film 36 is being wound manually around a load 80, as shown in FIG. 10, the axis 5 of the spool 38 is not necessarily vertical. When a spool of known type is tilted, that gives rise to a risk of the film being torn. Under such circumstances, the film 36 of the invention runs on the frustoconical or substantially conical portion of the margins 21 of the superposed layers and rolls up around an axis 82 parallel to the margin 21 of the paid-out film (see FIG. 11). The extra thickness of margin that is created in this way increases the tearing strength of the film. In addition, the film 36 of the invention presents residual tension in its margin 21, thereby further reducing the risk of tearing.

The present invention applies particularly to film 36 that has been subjected to stretching under tension lying in the range 10 $N/mm^2$ to 20 $N/mm^2$ of the initial cross-section of the film, to winding, and to relaxation on a core under mechanical tension lying in the range 10% to 90% of the stretching tension. Nevertheless, the invention also applies to winding films under stretching tension and also to winding stretched films under substantially no tension.

Although it is advantageous to cause the spool 32 and/or 38 to oscillate and/or move in translation during the operation of stretching the film, a method comprising a prior stretching step and a subsequent rewinding step with oscillation and/or translation of the feed and/or take-up spools would not go beyond the ambit of the present invention.

Naturally, the machine of the present invention can be fed directly from an extruder instead of from a feed spool 32.

The present invention applies mainly to wrapping with film that is paid out manually.

However, the present invention also applies to wrapping performed by wrapping machines.

We claim:

1. A machine for winding pre-stretched film from a feed spool onto a spool for taking up pre-stretched film, the machine comprising means for rotating at least one of the pre-stretched film take-up spool and the film feed spool, and including means for driving said feed spool relative to said take-up spool in such a manner as to vary periodically the positions of the margins of the film along the axis of the take-up spool, in such a manner that the margin of the wound film has a profile that is frustoconical or substantially conical.

2. A machine according to claim 1, wherein the means for driving the feed spool relative to the take-up spool provide relative displacement of an amplitude enabling the frustoconical or substantially conical profile of the film margin to be formed on said take-up spool so as to form an angle $\alpha$ relative to an axis of the take-up spool where $\alpha$ lies in the range 1° to 80°.

3. A machine according to claim 1, wherein the means for driving the feed spool relative to the take-up spool provide relative displacement of an amplitude enabling the frustoconical or substantially conical profile of the film margin to be formed on said take-up spool so as to form an angle $\alpha$ relative to an axis of the take-up spool where $\alpha$ lies in the range 3° to 45°.

4. A machine according to claim 1, wherein the means for driving the feed spool relative to the take-up spool provide relative displacement of an amplitude enabling the frustoconical or substantially conical profile of the film margin to be formed on said take-up spool so as to form an angle $\alpha$ relative to an axis of the take-up spool where $\alpha$ lies in the range 5° to 45°.

5. A machine according to claim 1, further comprising means for imparting oscillating reciprocating drive to one of the feed spool parallel to its axis and to the take-up spool parallel to its axis.

6. A machine according to claim 5, wherein the reciprocating drive means includes a wheel that is one of elliptical, oval, and eccentric, rotated about an axis orthogonal to the axis of rotation of one of the feed spool and the take-up spool; said wheel driving said feed spool or said take-up spool being parallel to said axis of rotation of the spool.

7. A machine according to claim 1, further including means for partially releasing the mechanical tension in the film after stretching and prior to winding on the take-up spool.

8. A machine for winding pre-stretched film from a feed spool onto a take-up spool, comprising a mechanism arranged to rotate at least one of the pre-stretched film take-up spool and the film feed spool; a driving mechanism arranged to drive one of the feed spool and take-up spool to periodically vary the positions of margins of the film along an axis of the take-up spool such that the margin of wound film has a profile that is at least one of frustoconical and substantially conical.

9. A method of winding pre-stretched film, the method comprising a step of stretching a film and a step of winding the stretched film on a take-up spool, wherein, during winding, relative displacement is ensured between film feed means and the take-up spool in such a manner as to vary the positions of the margins of the film periodically along the axis of the take-up spool, so that the margins of the wound film present a frustoconical or substantially conical profile on the take-up spool.

10. A method according to claim 9, wherein the displacement of the film feed means relative to the take-up spool is displacement of at least one of the feed spool parallel to its axis and of the take-up spool parallel to its axis.

11. A method according to claim 10, wherein the amplitude of the displacement lies in the range 1% to 4%, of the width of the film.

12. A method according to claim 10, wherein the feed spool is caused to perform oscillating reciprocating motion parallel to its axis.

13. A method according to claim 10, wherein outer wrapping film is wound on the take-up spool after it has been subjected to stretching at a tension lying in the range 10 $N/mm^2$ to 20 $N/mm^2$ of the initial cross-section of the film, and wherein the winding and relaxation of the film on the take-up spool takes place under mechanical tension lying in the range 10% to 90% of the stretching tension.

14. A spool of pre-stretched film obtained by the method according to claim 10.

15. A spool of film according to claim 14, wherein the ratio of the mechanical tension in the film wound on the central portion of the film spool relative to the tension in the margins lies in the range 1 to 5.

16. A spool according to claim 14, wherein the frustoconical or substantially conical profile forms an angle with the axis of the spool, said angle lying in the range 1° to 80°.

17. A spool according to claim 16, wherein the frustoconical or substantially conical profile forms an angle lying in the range 3° to 45°.

18. A spool according to claim 17, wherein the frustoconical or substantially conical profile forms an angle lying in the range 5° to 45°.

19. A spool according to claim 14, wherein the ratio of the mechanical tension in the film wound around the central portion of film spool relative to the tension in the margin lies in the range 1 to 3.

20. A method according to claim 10, wherein the amplitude of the displacement lies in the range 2% to 2.4%.

21. A method according to claim 9, wherein winding is performed with the positions of the margins of the film along the axis of the take-up spool being varied periodically at an outlet from where the film stretching occurs.

22. A method of winding pre-stretched film, the method comprising a step of stretching a film and a step of winding the stretch film on a take-up spool, wherein, during winding, relative displacement between a source of film feed and the take-up spool occurs to vary the positions of the margins of the films periodically along the axis of the take-up spool so that the margins of the wound film present a frustoconical or substantially conical profile on the take-up spool.

* * * * *